US005643014A

United States Patent [19]

Filus et al.

[11] Patent Number: 5,643,014

[45] Date of Patent: Jul. 1, 1997

[54] MOUNTING OF PROTECTORS IN CONNECTOR BLOCKS

[75] Inventors: Wayne Scott Filus, Lebanon; Antonio Albino Figueiredo, Belleville; Adam Stuart Kane, Morristown; Theodore Edward Kluska, Glen Rock; Wayne David Larsen, Indianapolis; Jeremia Patrick Starace, Nutley, all of N.J.

[73] Assignee: Lucent Technologies Inc., Murray Hill, N.J.

[21] Appl. No.: 442,898

[22] Filed: May 17, 1995

[51] Int. Cl.[6] ..... H01R 13/64

[52] U.S. Cl. ..... 439/680; 439/922

[58] Field of Search ..... 439/677, 678, 439/679, 680, 716, 718, 709, 922, 532

[56] References Cited

U.S. PATENT DOCUMENTS

| | | | |
|---|---|---|---|
| 3,364,458 | 1/1968 | Black, Jr. et al. | 439/680 |
| 3,798,587 | 3/1974 | Ellis, Jr. et al. . | |
| 4,171,857 | 10/1979 | Forberg et al. . | |
| 4,283,103 | 8/1981 | Forberg et al. . | |
| 5,380,216 | 1/1995 | Broeksteeg et al. | 439/680 |

*Primary Examiner*—Neil Abrams
*Assistant Examiner*—Yong Ki Kim

[57] ABSTRACT

A mounting arrangement between connector modules of a double-sided modular connecting block and polarity sensitive current and voltage limiting circuit protection devices. Connector modules having multiple pairs of insulation displacement connecting (IDC) terminals are insertable into a mounting bracket to form the double-sided connecting block. Exclusionary posts are selectively molded into a front and rear side of the connector modules and correspond to each pair of terminals. The posts on the front of a connector module align and mate with a cavity included on a front-mounted current and voltage limiting protection device. Similarly posts molded in a different location on the rear side of the connector module align and mate with a cavity included in a rear-mounted protection module. The corresponding posts and cavities create an exclusionary key and slot interface which prevents circuit protection devices of improper polarity from being inserted within the wrong side of a connector module. The exclusionary mounting scheme ensures against erroneous installation of circuit protection devices which can disrupt communications and provide inadequate circuit protection.

27 Claims, 7 Drawing Sheets

MOUNTING OF PROTECTORS IN CONNECTOR BLOCKS

RELATED APPLICATIONS

The present patent application is related to U.S. patent application Ser. Nos. 08/442,900 and 08/442,902 entitled Mounting Bracket And Ground Bar For A Connector Block and Common Insulating Housing For Elements Of Varying Terminals, both applications having filing dates of May 17, 1995, those applications having a common assignee and one or more common inventors and being incorporated herein by reference.

FIELD OF THE INVENTION

The present invention relates to connecting blocks for terminating telephone circuit wires, and more particularly to a scheme for mounting current and voltage limiting circuit protection on these connecting blocks to ensure proper polarity and operation.

BACKGROUND OF THE INVENTION

Individual pairs of telephone circuit wires are frequently terminated in telephone company central offices, distribution cabinets and customer premise locations, for example, utilizing multi-terminal connector blocks. Once terminated, these telephone circuit wires, usually comprised of cables containing narrow gauge insulated copper conductors, are grouped and then rerouted for appropriate distribution of the calls which they carry. Single connector blocks normally accommodate anywhere from 60 to 100 pairs of densely packed terminations, wherein multiple connector blocks are frequently contained in close proximity at a single location, e.g., one wall of a telephone switching room. Efficient utilization of mounting space is thus required since space within utility locations is traditionally at a premium.

Besides the incoming circuit terminations, the connector blocks are also utilized for making cross-connections from individual circuits on the connector blocks, as well as for the mounting of current and voltage limiting circuit protection used to prevent damage caused by lightening and other external forces. As is known, circuit protection devices which provide both current and voltage limiting circuit protection are polarity sensitive with respect to the individual pairs of wires being protected. Thus, when a double sided connecting block is utilized, wherein common pairs of terminals are included on both the front and rear of the connecting block, circuit protection devices adapted for installation on the front side of the connecting block are generally not compatible to provide circuit protection on the rear of the connecting block because the polarity will be reversed. Erroneous installation of a front circuit protection device in the rear of a connecting block and/or installation of a rear protection device in the front of a connecting block may render the communications circuit inoperable, or at the very least, improperly protected.

It is therefore an object of the present invention to provide a mounting interface for a double sided connecting block which ensures that polarity sensitive circuit protection devices cannot be improperly installed.

SUMMARY OF THE INVENTION

The present invention is a mounting arrangement between connector modules of a double-sided modular connecting block and polarity sensitive current and voltage limiting circuit protection devices. Connector modules having multiple pairs of insulation displacement connecting (IDC) terminals are insertable into a mounting bracket to form the double-sided connecting block. Exclusionary posts are selectively molded into a front and rear side of the connector modules and correspond to each pair of terminals. The posts on the front of a connector module align and mate with a cavity included on a front-mounted current and voltage limiting protection device. Similarly, posts molded in a different location on the rear side of the connector module align and mate with a cavity included in a rear-mounted protection module. The corresponding posts and cavities create an exclusionary key and slot interface which prevents circuit protection devices of improper polarity from being inserted within the wrong side of connector module. The exclusionary mounting scheme ensures against erroneous installation of circuit protection devices which can disrupt communications and provide inadequate circuit protection.

In a preferred embodiment of the present invention the connector modules, which include the exclusionary arrangement, are insertable into a hinged mounting bracket that is mounting at a telephone switching area to make up the modular connecting block. The hinged mounting bracket rotates open at a longitudinal edge to enable access to both front and rear terminals of the connecting modules and to allow circuit protection modules to be installed in both the front and rear of the connecting block.

BRIEF DESCRIPTION OF THE FIGURES

For a better understanding of the present invention, reference may be had to the following description of exemplary embodiments thereof, considered in conjunction with the accompanying drawings, in which.

DETAILED DESCRIPTION OF THE DRAWINGS

Figure 1:
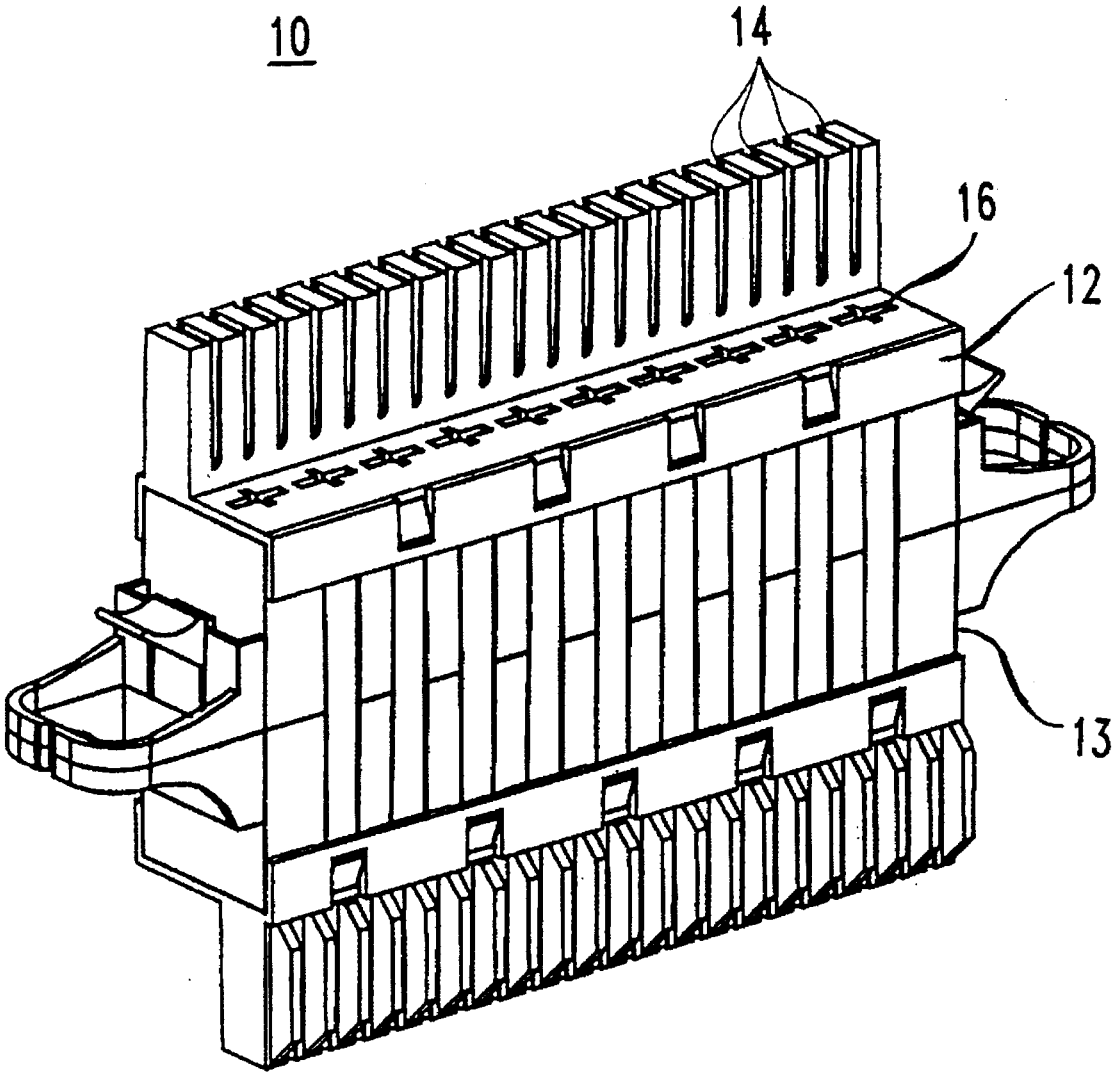
FIG. 1 shows a perspective view of one preferred embodiment of a connector module which utilizes the present invention exclusionary mounting arrangement.

The present invention is a mounting arrangement between a modular double-sided connecting block and circuit protection modules which are mountable into the connecting block to provide current and voltage limiting protection. Referring to FIG. 1, there is shown one preferred embodiment of a connector module 10 having insulation displacement connector (IDC) terminals included therein. The connector module 10, as shown, includes a terminal cap 12 having a plurality of slots 14 to allow for insertion of wires into the IDC terminals. The terminals are recessed within the terminal cap 12, wherein the terminal cap provides a number of useful functions. Some of these functions include providing a "quiet front" to protect craft from touching the terminals, preventing excess deflection of a terminal as a wire is inserted, forcing torsional displacement of the terminal beams as wire is inserted and providing a track to align and contain the terminals within. The housing 13 of the connector module 10 and terminal cap 12 also include receptacle slots 16 for receiving current and voltage limiting circuit protection modules. These circuit protection modules utilize, for example, gas tubes, positive temperature coefficient (PTC) devices and other like elements to provide circuit protection from electrical surges which can be prevalent on telephone communications wires.

Figure 2:
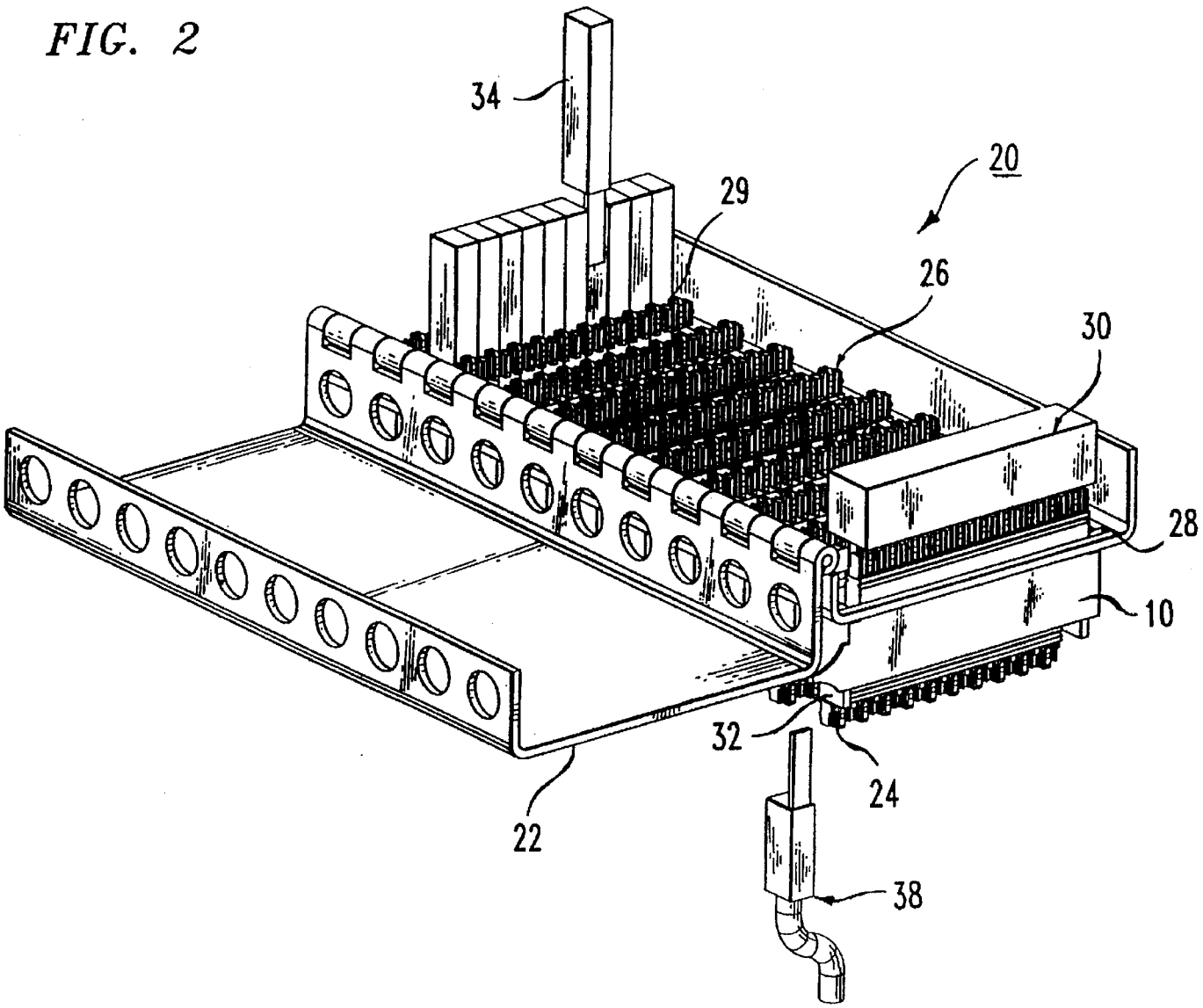
FIG. 2 shows a rear perspective view of one preferred embodiment of a connector block and hinged bracket using the connector modules of FIG. 1.

Referring to FIG. 2, there is shown one preferred embodiment of a connecting block 20 which is formed using the connector modules 10 of FIG. 1. The connector modules 10 are insertable into a hinged mounting bracket 22 which is designed to receive the modules. The mounting bracket 22 is hinged in order to provide easy access to front and rear terminals 24, 26, respectively, of the connecting block 20 when the bracket is mounted. Circuit protection modules are shown inserted into connector modules 10 mounted in a first receptacle slot 28 and last receptacle slot 29 of the bracket. The first slot 28 illustrates insertion of a cartridge protector module 30 which acts to provide current and voltage limiting circuit protection for all pairs of terminals included on the associated connector module 10. The cartridge protector module couples to support posts 32 of the mounting bracket to provide a low resistance discharge path in the event of an electrical surge. The last slot 29 of the mounting bracket 22 is shown including a connector module having a plurality of individual circuit protector modules 34 installed. The individual circuit protectors 34 provide current and voltage limiting circuit protection to individual pairs of terminals included on a connector module 10. The individual circuit protection modules connect to a ground bar 36 (shown in FIG. 3) which in turn couples to support posts 32 on the mounting bracket. The ground bar 36 runs the entire length of a mounting slot in the bracket, in order that individual protectors 34 may be inserted to protect any pair of terminals on the connector module 10. A test plug 38 (FIG. 2) may also be inserted in the front of each of the connector modules in the same receptacle slots 16 as the circuit protectors. The test plug 38 allows for testing and monitoring of circuits which are terminated at the connecting block 20 without having to disturb any of the terminations.

Figure 3:
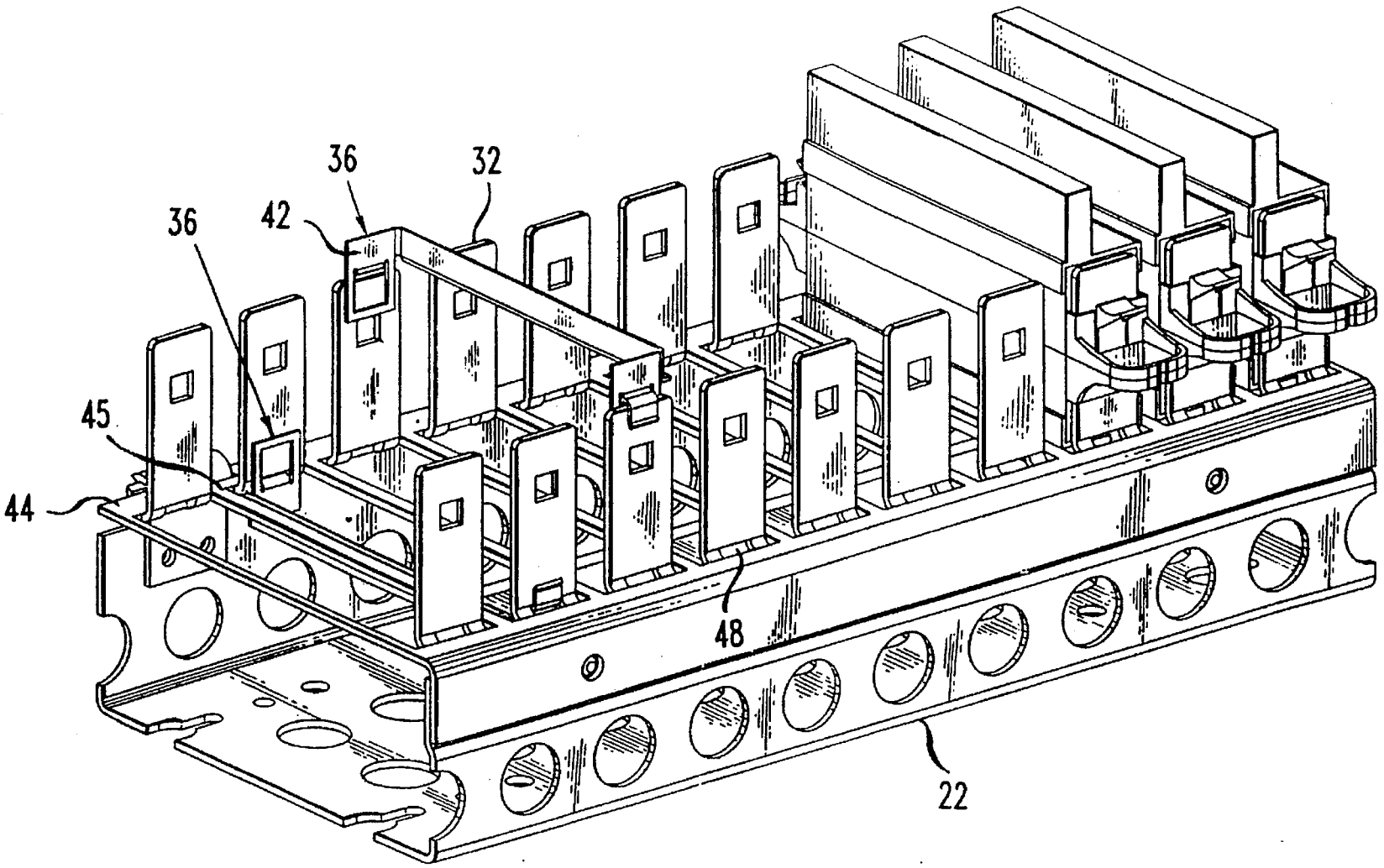
FIG. 3 shows a front perspective view of a hinged mounting bracket having ground bars installed in the from and rear of the bracket.

Referring to FIG. 3, there is shown one preferred embodiment of the mounting bracket 22 having a ground bar 36 installed thereon. The ground bar 36, as shown, includes clips 42 on either side thereof for attaching to tops of the support posts 32 on the front side 44 of the mounting bracket. The individual protection modules 34 couple to the ground bar 36, as mentioned, to provide a low resistance discharge path. The ground bar 36 also has the capability of attaching to the rear of the mounting bracket. This is shown at the second position 45 of the mounting bracket 22, wherein the support posts 32 include a slot 48 at a point where the posts 32 couple with the bracket housing. The slot 48 allows the clips 42 of the ground bar to slide onto a rear side of the support posts for back mounting. The flexible mounting scheme of the ground bar 36 enables individual circuit protection modules to be mounted on either the front or rear of a connecting block 20. The cartridge protection modules 30 are also mountable to the front or rear of a connecting block because of their internal grounding arrangement which couples to the mounting bracket.

Figure 4D:
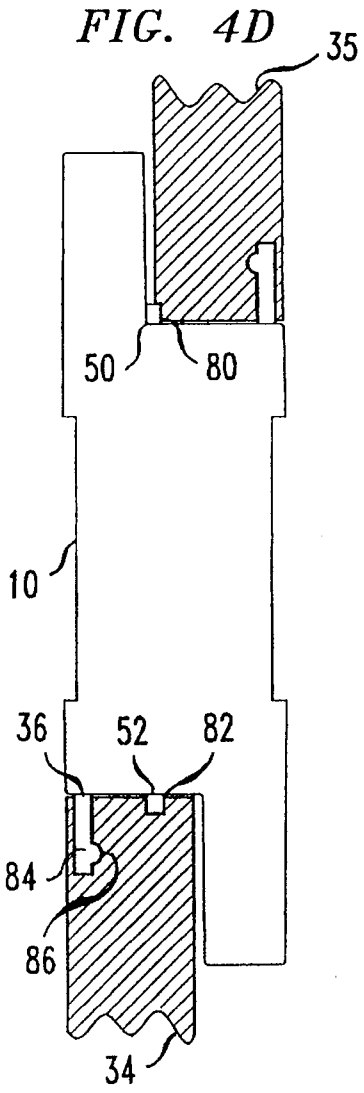
FIG. 4D shows a cross section of the connector module with a circuit protection modules coupled to front and rear side locations to illustrate the present invention exclusionary interface.
Figure 4C:
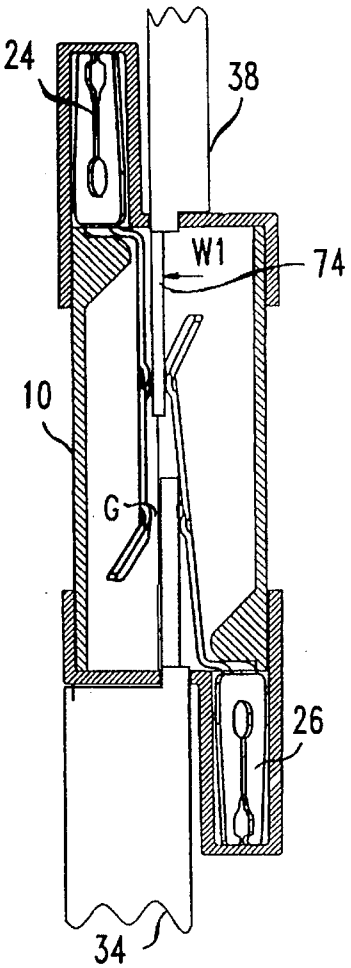
FIG. 4C shows a cross sectional view of a connector module having both a circuit protection module and a test plug installed therein.
Figure 4B:
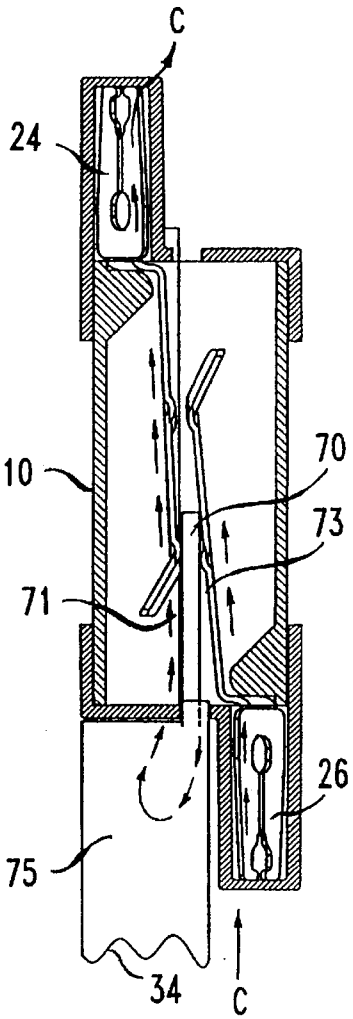
FIG. 4B shows a side cross sectional view of the connector module having a circuit protection module installed within a rear side receptacle.
Figure 4A:
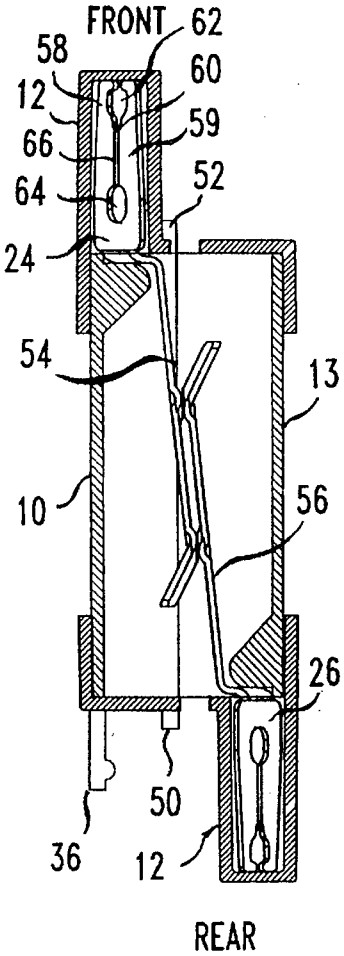
FIG. 4A shows a side cross sectional view of a connector module which illustrates the present invention exclusionary mounting arrangement.
Figure 5A:
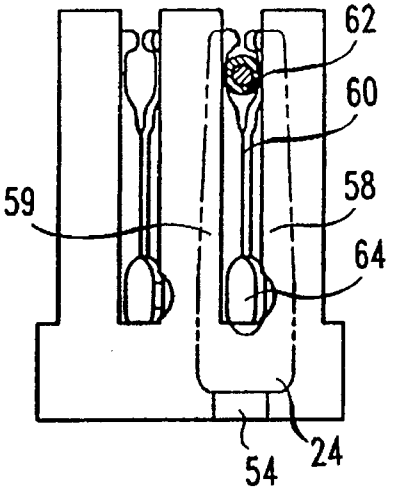
FIGS. 5A–5E show the connecting terminals during various stages of wire insertion.
Figure 5B:
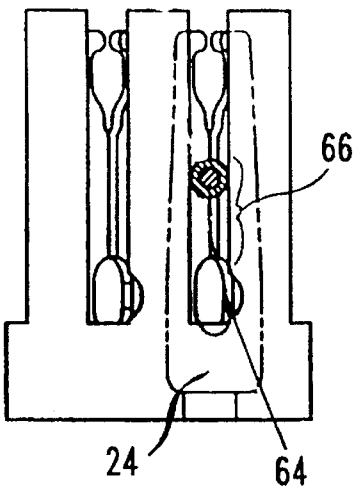
Figure 5C:
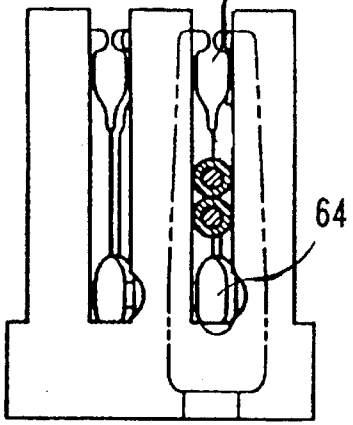
Figure 5D:
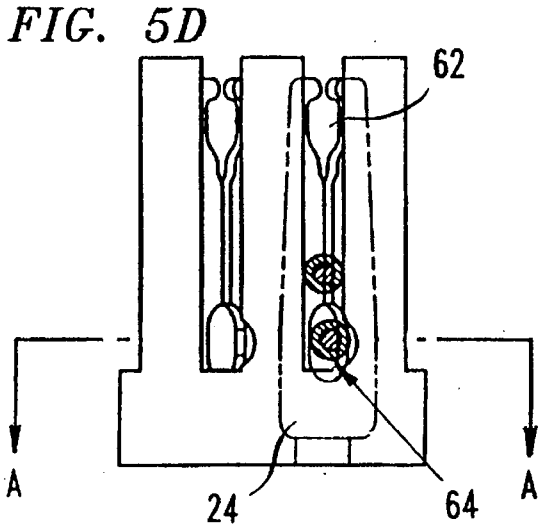
Figure 5E:
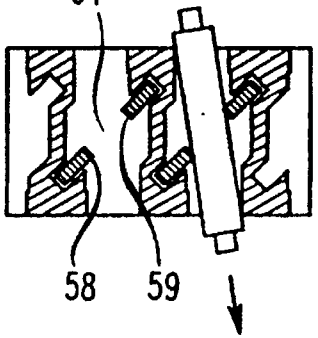

Referring to FIG. 4A, there is shown a cross-section of one preferred embodiment of a connector module 10. The connector module is shown with terminal caps 12 installed on both the front and rear side of the housing 13 and over terminals 24, 26. The ground bar 36 is shown as it would be oriented in a rear installation into the mounting bracket 22. A rear exclusion post 50, which is part of the present invention circuit protection interface arrangement, couples to the housing 13 and is shown mounted proximate the ground bar 36 in an interior region in the rear of the connector module 10. A front exclusion post 52 is shown mounted on the front of the connector module 10, wherein the front post 52 is located at a different orientation closer to the terminal 24 and proximate the receptacle slot 16. Thus, front and rear exclusion posts 50, 52 are located at different positions relative one another on the connector module 10. Stem members 54, 56 are also shown coupled to each of the front and rear terminals 24, 26, respectively. The extension members 54, 56 bias against one another to form a normally closed contact.

FIG. 4A in combination with FIGS. 5A–5E also illustrate the geometry of the terminals 24, 26 which are used to make terminations on the connecting block. These terminals 24, 26 are insulation displacement connector-type (IDC) terminals which automatically cut and displace the insulation of a wire in order to make connection with the metallic conductor contained inside the insulation. The IDC terminal 24 is a unitary connecting element having two arms 58, 59 and a slot 60 centrally disposed therein. The base of the terminal 24 couples to the stem member 54 which continues into an interior portion of the housing 13 of the associated connector module 10. The two arms 58, 59 of the terminal 24 which define the slot 60 are shaped so as to define a widened slot proximate a top edge of the terminal, hereinafter referred to as the retaining region 62. A second widened slot is located toward the base of the module 10 and, as will be understood, this second widened slot is referred to as the removal aperture 64. The retaining region 62 of the terminal 24 is advantageous in that, when desired, individual conductors may be held within the retaining region 62 of the terminal 24 prior to insertion. Accordingly, all conductors may be dressed into the terminals 24 of a connector module as one operation and then seated into the IDC terminals as a second operation. The terminals of the connector module 10 are adapted to receive conductor wires of various sizes, e.g., 20–26 AWG, of both a solid and stranded variety. The width of the slot in the retaining region 62 is gradually tapered to widths that are slightly less than the outer diameter of wires to be inserted therein. Also the two arms 58, 59 of the terminal 24 are essentially formed as a spring contact. Thus, varying gauges of wire are held securely in the retaining region 62 prior to termination.

The IDC terminal 24 is adapted to terminate a wire which is inserted into the slotted IDC portion 66 of the terminal. As will be understood the distance between the arms 58, 59 in the IDC portion 66 of the terminal 24 is less than the minimum diameter of a conductor to be inserted. Inside facing edges of the terminal arms 58, 59 facing the slot 60 terminate with sharpened edges in order that the protective insulation of a conductor inserted at the IDC portion 66 of the terminal will have the insulation cut and/or displaced by the sharpened edges. The conductor contained within the insulated wire will make physical contact with the arms 58, 59 of the terminal 24, thereby producing an electrical connection between the conductor and the terminal 24. It will be noted that each of the arms of the terminal 24 separately cuts into the insulation of the wire to ensure a gas tight connection.

The removal aperture 64 located at the base region of the terminal 24 is considerably wider than the terminal slot 60 at the IDC region 66. The removal aperture 64 is generally elliptical and is also somewhat wider at its middle region than the outermost diameter of any conductor wire specified for insertion into the terminal 24. Since the aperture 64 is wider than the diameter of an inserted conductor wire, a first conductor inserted within the terminal may be slid down through the IDC area 66 into the removal aperture 64 and removed. Removal of a first of two conductors from the IDC terminal 24 is thus accomplished without disturbing or jeopardizing the integrity of the second connection. The removal aperture also enables somewhat less torsional retaining force to be exerted on the arms 58, 59 of the IDC portion 66 of the terminal 24 from the solid base region of the terminal 24 when certain size wires are inserted. This allows the arms 58, 59 of the terminal to more freely twist under certain circumstances, allowing larger and/or more than one conductor to be inserted into the terminal 24 without permanently yielding the arms 58, 59 or beams of the terminal, since the large flat contacts of the IDC portion 66 of the terminal 24 displace torsionally when normal forces exceed a fixed load. This helps preserve the original structure of the terminal 24 and increase its usable life for subsequent insertions.

Referring to FIG. 4B, the connector module 10 is shown with a single terminal pair protector unit 34 installed into a rear receptacle slot. The single unit protector 34 is inserted within the rear of the connector module 10, wherein a conductive element 70 from the protector makes contact with both the front and rear terminals 24, 26 of the connector module and break contact at front side contact points. Front 71 and rear sides 73 of the conductor bar 70 which couple to the respective terminals 24, 26 of the connector module 10 are insulated from one another, thus current flow is directed within the protector module 34. A protection circuit (FIGS. 6A–6D) is included in a cap region 75 of the protector module 34 to provide voltage and current limiting protection. FIG. 4B illustrates the direction of current flow from an incoming circuit which is terminated at the rear terminal 26 of the connector module. As can be seen, the protector module 34 is inserted in series between the front and rear terminals 24, 26 and current is forced to flow through the circuit of the protection module. Insertion of the protector 34 thus causes a separation between the front and back terminals 24, 26 of the connector module 10 so that current flows through the protector 34.

Referring to FIG. 4C, a connector module 10 is shown having an individual protector 34 installed in the rear of the module and a test plug 3 installed in the front side of the module 10. A tab 74 is included on the conductive stem of the test plug 38 having sufficient width W1, to bias part of the stem members 54, 56 of the terminals 24, 26 when the test plug is inserted. A gap G of predetermined width is created between the front facing terminal 24 of the connector module and the conductive bar 70 of the individual protector module 34 when the test plug 38 is inserted. The rear side terminals 26 (or cable termination side) remains coupled to the protector unit 34 to provide voltage only protection. The test plug 38, in a similar fashion to the circuit protection module 34, 30, is inserted in series between the front and rear terminals 24, 26 of a connector pair. The test plug 38 and its associated circuitry will be adapted to test both In and Out of circuit, i.e., provide test access to terminated cables inside the plant or outside cables terminated at the rear of a connector block. The test plug 38 may also provide the capability to establish a through connection between front and rear terminations to allow for monitoring. The above demonstrates the ability to test bi-directionally utilizing the test plug feature, while at the same time maintaining circuit protection on the rear or cable termination side of the connector block.

Referring to FIG. 4D, the present invention exclusionary mounting arrangement is illustrated as protection modules 34, 35 are shown inserted into the front and rear of a connector module 10. The exclusionary interface is utilized to ensure proper polarity insertion of the protection modules 34, 35 into the front and rear of the connector module 10. The interface is comprised of a key and slot system which prohibits insertion of a protection module with improper polarity. A rectangular protrusion of the rear exclusion post 52 forms a key within the central interior section on the rear of the connector module 10. A corresponding cavity 82 or slot on a rear mountable protection module 34 aligns with the rear exclusion post 52 and allows the protection module 34 to be fully inserted within the connector module 10. The front rectangular exclusion post 50 is disposed proximate the front receptacle slot 16 and forms the front key. A corresponding cavity 80 on a front mountable protection module 35 mates with the front exclusion post 50 to enable a full insertion into the receptacle slot 16. Thus, the orientation of the exclusion posts 50, 52 on the front and rear of the connector module precludes front-only protection modules 35 being inserted into the rear of a connector module and, vice-versa, a rear-only protection module 34 cannot be inserted into the front of a connector module 10. Accordingly, the present invention interface excludes insertion of current and voltage limiting protection modules with improper polarity.

There are cases, however, where protection modules are not polarity specific, as in the case of voltage-only protection modules which are not required to make a series connection. Since voltage-only protection modules are not polarity specific, they may be inserted into the front or rear of a connector module 10, where these protection modules perform equally well in either location. Voltage-only protection modules can thus be outfitted with dual cavities which align and mate with exclusion posts 50, 52 on both the front and rear of a connector module. This enables the voltage-only protection modules to be inserted on either side of the connector module 10 for increased flexibility and cost savings to the user. Although the present invention exclusionary interface is shown using rectangular exclusion keys and cavities, it will be understood that other types of protrusions and associated slots along with other orientations therefor may also be utilized. In addition, it will be understood that keys or protrusions may be included to extend from the circuit protection modules rather than the connector module housing creating an essentially inverted exclusion scheme and that the shown embodiments are merely illustrative of the present invention interface.

FIG. 4D also shows that the individual protector 34 includes a cavity 84 which is adapted to receive and mate with the ground bar 36, that as described with respect to FIG. 3, couples to the mounting bracket 22 to thereby establish an electrical discharge path for the protector. The ground bar 36 as shown is designed to fit over the connector module 10 and a positive seat 86 on the ground bar will indicate when an individual protector 34 is fully inserted. Individual protectors 34, 35 and corresponding ground bars 36 are shown installed in both the front and rear of the connector module 10. This is done for illustration purposes to show the flexibility of the connector module system. Practical applications would normally require only that protection to be installed at one of these locations.

Figure 6A:
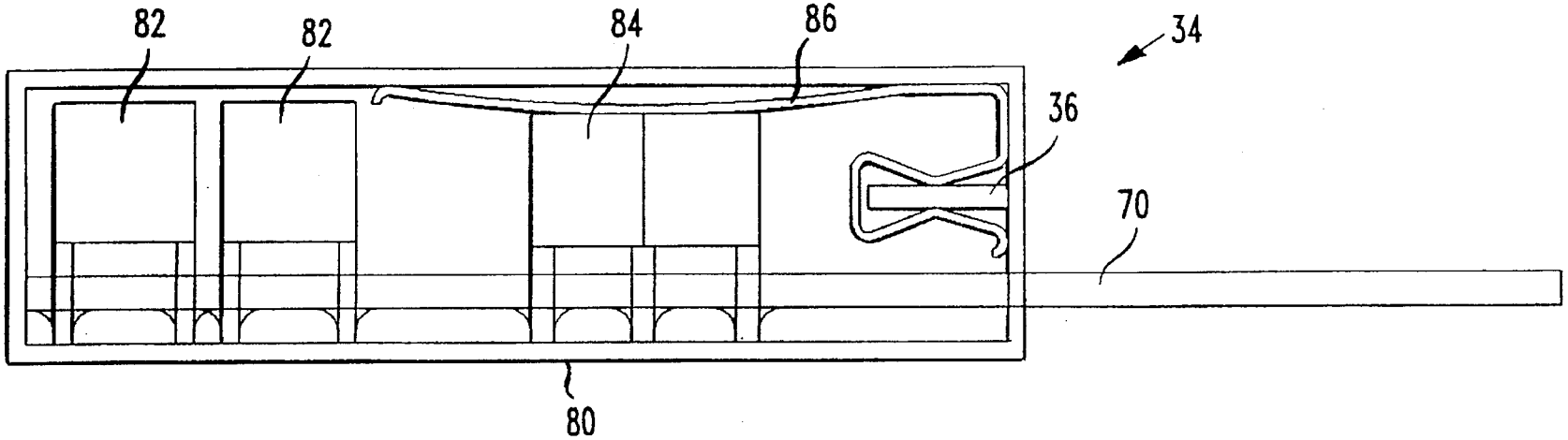
FIG. 6A shows one preferred arrangement for the internal components of a circuit protection module.

Referring to FIG. 6A there is shown a side cross sectional view of a protector module 34 illustrating the internal components thereof. It will be understood, however, that the illustration of FIG. 6A may be representative of both individual circuit protection modules and cartridge type protectors 30. The figure shows that the protective module includes a housing 80 which contains the protective components. The conductive bar 70 which in actuality a printed circuit board is partially contained within the housing 80 and extends outwardly therefrom for insertion into a connector module 10. As has been discussed the conductive bar 70 or PC board has one side insulated from the other, where each side includes a different wiring board layout. The bar 70 has a first and second solid state positive thermal coefficient (PTC) devices 82 mounted thereto to provide current limiting protection. As is know PTC devices create an open circuit upon reach a predetermined current (or temperature) threshold. The bar also has a voltage limiting device 84, for example a gas tube overvoltage protector mounted thereto. Upon exposure to predetermined voltage level, a thermal overload element within the voltage protector 84 enables coupling to ground bus 86. The ground bus, in turn, couples to ground bar 36 to provide a discharge path. It will be understood, that the ground bar 36 may be internal to a protection cartridge 30 or external to the module as explained with respect to the individual protector 34.

Figure 6B:
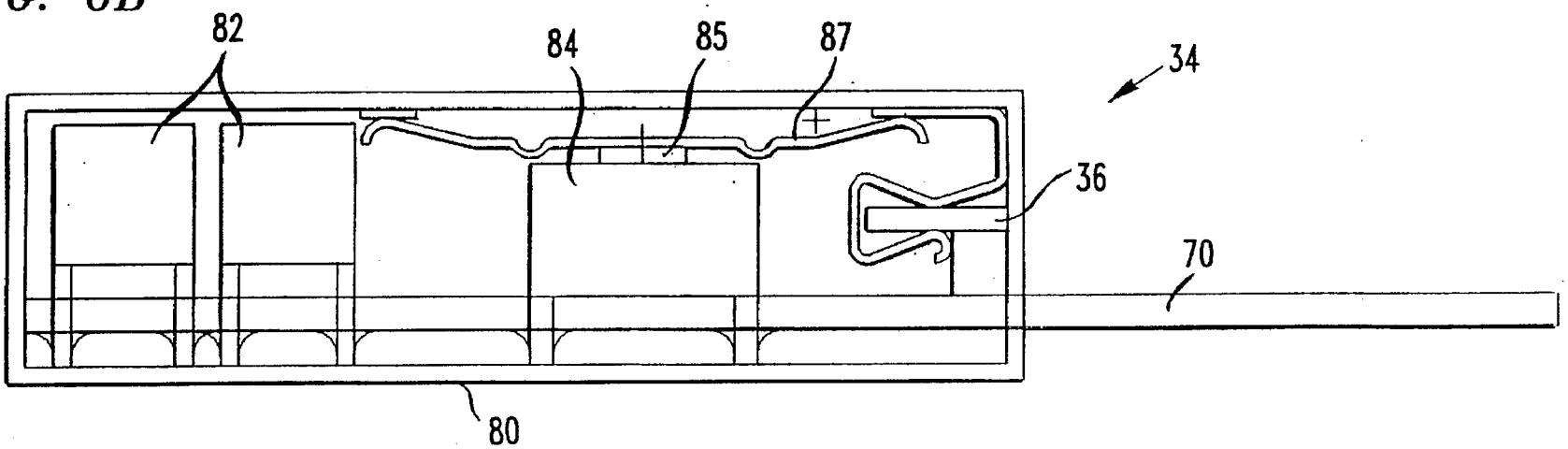
FIG. 6B shows a second preferred embodiment for the internal components of a circuit protection module.

FIG. 6B shows a second preferred embodiment for the internal configuration of a protector module, wherein like components are numbered as in FIG. 6A. The difference with FIG. 6B is that the voltage limiting device 84 includes an external thermal overload means 85, for example a lead pellet. Upon reaching a predetermined voltage (or temperature) the pellet melts, which enables coupling of the ground bus 87 to the voltage limiting device to establish a discharge path.

Figure 6C:
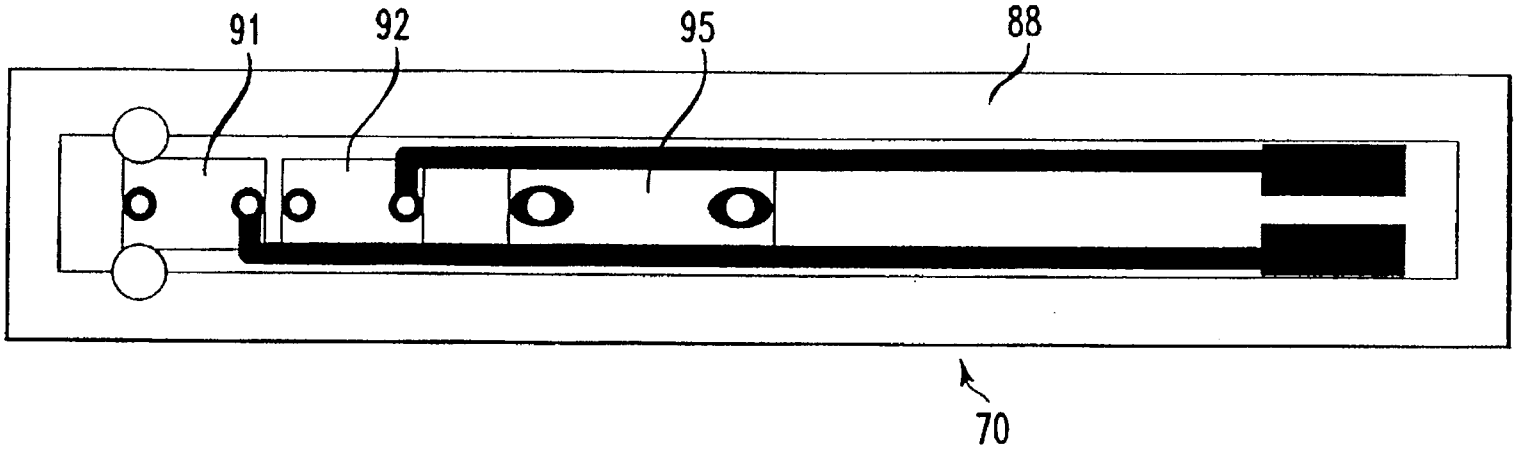
FIGS. 6C and 6D show one preferred embodiment for alternate sides of a printed circuit board used with the protection modules.
Figure 6D:
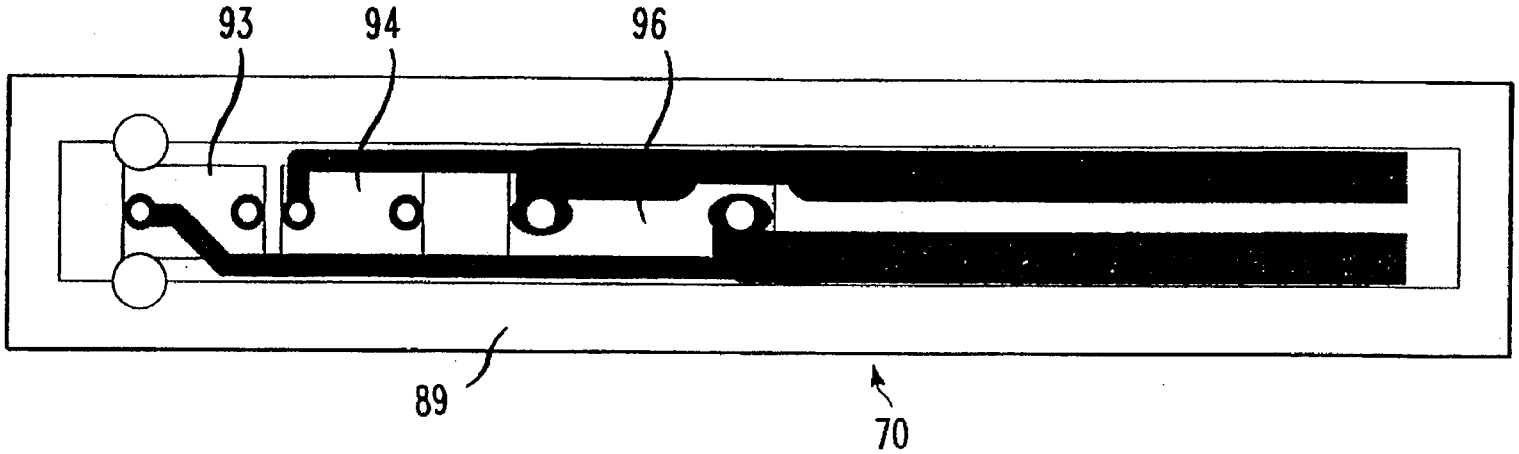

A unique feature of the protector modules 34, 30 is that the same conductor bar 70 or PC board may be used for implementation of either polarity specific protector module, i.e., front-only mounted or rear-only mounted. This is because the same components can be mounted on either side of the board in the exact same location. FIGS. 6C and 6D illustrate this point more clearly. FIG. 6C shows a first side 88 of the PC board 70, while FIG. 6C shows a second side 89 of the board. As can be seen locations 91 and 92 on the first side 88 correspond directly to location 93 and 94, wherein current limiting protection devices 82 may be mounted on either side of the board. Similarly locations 95 and 96 enable the voltage limiting protection 84 to be mounted on either the first or second side 88, 89 of the board 70. Thus, the same conductive element PC board 70 may be used for either polarity protector depending on which side of the board 70 the components are mounted upon. and assembled within the housing 80. FIGS. 6A and 6B also illustrate that voltage-only protection modules will utilize the same board 70 as current and voltage limiting protectors. In the case of voltage only protectors, the current limiting devices are simply not installed.

From the above, it should be understood that the embodiments described, in regard to the drawings, are merely exemplary and that a person skilled in the art may make variations and modifications to the shown embodiments without departing from the spirit and scope of the invention. All such variations and modifications are intended to be included within the scope of the invention as defined in the appended claims.

What is claimed is:

1. A mounting arrangement for use in a modular connecting block system, wherein connector modules having insulation displacement connecting terminals on front and rear sides thereof are insertable into a mounting bracket to form a connecting block, and wherein said connector modules are adapted to receive polarity sensitive insertable current and voltage limiting circuit protection devices on said front and rear sides of said connector modules for protecting individual pairs of said terminals, said arrangement comprising:

a connector module housing for housing said connecting terminals, said housing including, first exclusion means disposed on said front side of said connector module housing; and second exclusion means disposed on said rear side of said connector module housing, said second exclusion means being disposed at a different location than said first exclusion means relative to said insertable protection devices, wherein said first exclusion means mates with front-only mountable ones of said protection devices and said second exclusion means mates with rear-only mountable ones of said protection devices, thereby excluding a front-only mountable protection device from insertion into said rear side of said connector module and excluding a rear-only mountable protection device from insertion into said front side of said connector module.

2. The arrangement of claim 1, wherein each of said first and second exclusion means include at least one protrusion extending vertically upward from said connector module housing.

3. The arrangement of claim 2, further including a front-only mountable protection device, said front only protection device including a housing which defines a first cavity means adapted to mate with said first exclusion means of said connector module housing and a rear-only mountable protection device including a housing which defines a second cavity means adapted to mate with said second exclusion means of said connector module housing.

4. The arrangement of claim 1, wherein said first and second exclusion means include cavities adapted to mate with protrusions extending from said protection devices.

5. The arrangement of claim 3, further including a non-polarity sensitive protection device adapted for insertion in either said front or rear side of said connector module, said protection device including a housing defining both said first and second cavity means, wherein said protection device mates with either said first or second exclusion means of said connector module housing.

6. The arrangement of claim 5, wherein said non-polarity sensitive protection device is a voltage surge protection device.

7. The arrangement of claim 3, wherein said second cavity means is oriented within a central region of said housing of said rear-only protection device and wherein said first cavity means is oriented at an edge of said housing of said front-only protection device.

8. The arrangement of claim 3, wherein said mounting bracket is adapted to receive a ground bar for coupling with said circuit protection devices to provide a low resistance discharge path, and said front-only and rear-only protection devices have defined therein a slot adapted to couple with said ground bar.

9. The arrangement of claim 1, wherein said front and rear sides of said connector module include different color codings and said front-only protection modules include a color coding corresponding to said color coding of said front side and said rear-only protection modules include a color coding corresponding to said color coding of said rear side of said connector module.

10. In a modular connecting block system, a mounting arrangement, wherein connector modules having insulation displacement terminals on front and rear sides thereof are insertable into a mounting bracket to form a connecting block, wherein said connector modules are adapted to receive polarity sensitive insertable current and voltage limiting circuit protection devices on said front and rear sides of said connector modules for protecting individual pairs of said terminals, and wherein a circuit protection device mountable at a front side of a connector module is not interchangeable with a circuit protection device mountable at a rear side of said connector module, said mounting arrangement comprising:

a connector module housing for housing said insulation displacement terminals, said housing including, first vertically protruding key disposed on said front side of said connector module housing; and second vertically protruding key disposed on said rear side of said connector module housing, said second key being disposed at an alternate location relative said first key with respect to said insertable protection devices, wherein said first key mates with a corresponding first slot on a front-only mountable protection device and said second key mates with a corresponding second slot on a rear-only mountable protection device, whereby said front-only mountable protection device is excluded from insertion into said rear side of said connector module and said rear-only mountable protection device is excluded from insertion into said front side of said connector module.

11. The arrangement of claim 10, wherein said first and second vertically protruding keys include a post extending from said connector module housing.

12. The arrangement of claim 10, further including a front-only mountable protection device, said front only protection device including a housing which defines said first slot adapted to mate with said first key of said connector module housing and a rear-only mountable protection device including a housing which defines said second slot adapted to mate with said second key of said connector module housing.

13. The arrangement of claim 11, further including a non-polarity sensitive protection device adapted for insertion in said front and rear side of said connector module, said protection device including a housing defining both said first and second slots, wherein said protection device mates with said first and second key of said connector module housing, thereby enabling said device to be inserted in said front and rear side of said connector module.

14. The arrangement of claim 13, wherein said non-polarity sensitive protection device is a voltage surge protection device.

15. The arrangement of claim 9, wherein said second key is oriented within a central region of said rear side of said connector module housing and said first key is oriented toward an edge of said front side of said connector module housing.

16. In a modular connecting block system, wherein connector modules having connecting terminals on front and rear sides thereof are insertable into a mounting bracket to form a connecting block, and wherein said connector modules are adapted to receive polarity sensitive insertable current and voltage limiting circuit protection devices on said front and rear sides of said connector modules for protecting individual pairs of said terminals, a protector module device comprising:

a housing for containing voltage and current limiting protection means; and at least one conductive stem insertable within a housing of said connector module to thereby couple with said connecting terminals, said stem extending from said housing and coupled to said protection means, wherein said protector module device is insertable in either said front or rear sides of said connector module, and wherein said housing includes exclusion means, wherein a first polarity protection device is excluded from insertion into said front side of said connector module and a second polarity device is excluded from insertion into said rear side of said connector module.

17. In a modular connecting block, system wherein connector modules having connecting terminals on front and rear sides thereof are insertable into a mounting bracket to form a connecting block and wherein said connector modules are adapted to receive polarity sensitive insertable current and voltage limiting circuit protection devices on said front and rear sides of said connector modules for protecting individual pairs of said terminals, a protector module device comprising:

a housing for containing voltage and current limiting protection means: and at least one conductive stem insertable within a housing of said connector module to thereby couple with said connecting terminals, said stem extending from said housing and coupled to said protection means, wherein said protector module device is insertable in either said front or rear sides of said connector module, and wherein said protection means are selected from the group consisting of gas tube, carbon-type, PTC and solid state protection devices.

18. The device of claim 17, wherein said protector module device is a protector cartridge adapted to protect multiple pairs of terminals in said connector module, wherein said housing includes multiple protection means for protection of said multiple pairs of terminals.

19. The device of claim 18, wherein said protector module device includes an internal ground bus adapted to couple with said mounting bracket to thereby provide a discharge path to ground.

20. The device of claim 17, wherein said housing is color coded so as to correspond to a color code on said front or rear sides of said connector module, wherein said color code for said front ad rear sides is different.

21. In a modular connecting block system, wherein connector modules having connecting terminals on front and rear sides thereof are insertable into a mounting bracket to form a connecting block, and wherein said connector modules are adapted to receive polarity sensitive insertable current and voltage limiting circuit protection devices on said front and rear sides of said connector modules for protecting individual pairs of said terminals, a protector module device comprising:

a housing for containing voltage and current limiting protection means, and at least one conductive stem insertable within a housing of said connector module to thereby couple with said connecting terminals, said stem extending from said housing and coupled to said protection means, wherein said protector module device is insertable in either said front or rear sides of said connector module, and wherein said protector module device is a single protector unit adapted to protect single pairs of terminals on said front and rear sides of said connector module.

22. The device of claim 21, wherein said housing includes a cavity adapted to attach to a ground bar on said mounting bracket, thereby enabling said protection means to couple with said ground bar.

23. In a modular connecting block system, wherein connector modules having connecting terminals on front and rear sides thereof are insertable into a mounting bracket to form a connecting block, and wherein said connector modules are adapted to receive polarity sensitive insertable current and voltage limiting circuit protection devices on said front and rear sides of said connector modules for protecting individual pairs of said terminals, a protector module device comprising:

a housing for containing voltage and current limiting protection means, and at least one conductive stem insertable within a housing of said connector module to thereby couple with said connecting terminals, said stem extending from said housing and coupled to said protection means, wherein said protector module device is insertable in either said front or rear sides of said connector module, and wherein said conductive stem includes a printed circuit board, wherein orientation of insertion within said housing of said conductive stem determines the polarity of a protection device, wherein said protection means may be insertable on either side of said printed circuit board in similar locations, thereby enabling said same printed circuit board to be utilized as part of a front-only mountable protection device and a rear-only mountable protection device.

24. The device of claim 23, wherein current and voltage limiting protection modules and voltage-only limiting protection modules utilize said same printed circuit board, wherein said voltage-only limiting protection devices do not have current limiting devices installed into said circuit board.

25. A mounting arrangement for use in a modular connecting block system, wherein connector modules having connecting terminals on front and rear sides thereof are insertable into a mounting bracket to form a connecting block, and wherein said connector modules are adapted to receive polarity sensitive insertable current and voltage limiting circuit protection devices on said front and rear sides of said connector modules for protecting individual pairs of said terminals, said arrangement comprising:

a connector module housing for housing said connecting terminals, said housing including, first exclusion means disposed on said front side of said connector module housing;

second exclusion means disposed on said rear side of said connector module housing, said second exclusion means being disposed at a different location than said first exclusion means relative to said insertable protection devices, wherein said first exclusion means mates with front-only mountable ones of said protection devices and said second exclusion means mates with rear-only mountable ones of said protection devices, thereby excluding a front-only mountable protection device from insertion into said rear side of said connector module and excluding a rear-only mountable protection device from insertion into said front side of said connector module; said arrangement further including, a front-only mountable protection device, said front only protection device including a housing which defines a first cavity means adapted to mate with said first exclusion means of said connector module housing and a rear-only mountable protection device including a housing which defines a second cavity means adapted to mate with said second exclusion means of said connector module housing; and a non-polarity sensitive protection device adapted for insertion in either said front or rear side of said connector module, said protection device including a housing defining both said first and second cavity means, wherein said protection device mates with either said first or second exclusion means of said connector module housing.

26. A mounting arrangement for use in a modular connecting block system, wherein connector modules having connecting terminals on front and rear sides thereof are insertable into a mounting bracket to form a connecting block, and wherein said connector modules are adapted to receive polarity sensitive insertable current and voltage limiting circuit protection devices on said front and rear sides of said connector modules for protecting individual pairs of said terminals, said arrangement comprising:

a connector module housing for housing said connecting terminals, said housing including, first exclusion means disposed on said front side of said connector module housing; and second exclusion means disposed on said rear side of said connector module housing, said second exclusion means being disposed at a different location than said first exclusion means relative to said insertable protection devices, wherein said first exclusion means mates with front-only mountable ones of said protection devices and said second exclusion means mates with rear-only mountable ones of said protection devices, thereby excluding a front-only mountable protection device from insertion into said rear side of said connector module and excluding a rear-only mountable protection device from insertion into said front side of said connector module; said arrangement further including, a front-only mountable protection device, said front only protection device including a housing which defines a first cavity means adapted to mate with said first exclusion means of said connector module housing and a rear-only mountable protection device including a housing which defines a second cavity means adapted to mate with said second exclusion means of said connector module housing, wherein said second cavity means is oriented within a central region of said housing of said rear-only protection device and wherein said first cavity means is oriented at an edge of said housing of said front-only protection device.

27. A mounting arrangement for use in a modular connecting block system, wherein connector modules having connecting terminals on front and rear sides thereof are insertable into a mounting bracket to form a connecting block, and wherein said connector modules are adapted to receive polarity sensitive insertable current and voltage limiting circuit protection devices on said front and rear sides of said connector modules for protecting individual pairs of said terminals, said arrangement comprising:

a connector module housing for housing said connecting terminals, said housing including, first exclusion means disposed on said front side of said connector module housing; and second exclusion means disposed on said rear side of said connector module housing, said second exclusion means being disposed at a different location than said first exclusion means relative to said insertable protection devices, wherein said first exclusion means mates with front-only mountable ones of said protection devices and said second exclusion means mates with rear-only mountable ones of said protection devices, thereby excluding a front-only mountable protection device from insertion into said rear side of said connector module and excluding a rear-only mountable protection device from insertion into said front side of said connector module; said arrangement further including, a front-only mountable protection device, said front only protection device including a housing which defines a first cavity means adapted to mate with said first exclusion means of said connector module housing and a rear-only mountable protection device including a housing which defines a second cavity means adapted to mate with said second exclusion means of said connector module housing, wherein said mounting bracket is adapted to receive a ground bar for coupling with said circuit protection devices to provide a low resistance discharge path, and said front-only and rear-only protection devices have defined therein a slot adapted to couple with said ground bar.

* * * * *